US007541923B2

(12) United States Patent
Chien

(10) Patent No.: US 7,541,923 B2
(45) Date of Patent: Jun. 2, 2009

(54) METHOD FOR AND SYSTEM OF INTRUSION DETECTION BY USING ULTRASONIC SIGNALS

(75) Inventor: Yi-Tsung Chien, Su-ao Township, Yilan County (TW)

(73) Assignee: Industrial Technology Research Institute, Hsinchu (TW)

( * ) Notice: Subject to any disclaimer, the term of this patent is extended or adjusted under 35 U.S.C. 154(b) by 1025 days.

(21) Appl. No.: 11/034,146

(22) Filed: Jan. 12, 2005

(65) Prior Publication Data

US 2006/0173349 A1 Aug. 3, 2006

(51) Int. Cl.
*G08B 13/00* (2006.01)

(52) U.S. Cl. ..... 340/541; 340/500; 340/540; 340/545.1; 340/522; 340/552; 73/602; 73/607; 73/625; 73/626

(58) Field of Classification Search ..... 340/541, 340/500, 540, 545.1, 552, 522; 73/602, 620, 73/627, 628, 629, 631, 625, 607, 626; 367/7, 367/93, 94, 99, 112; 701/207; 109/21, 31, 109/38

See application file for complete search history.

(56) References Cited

U.S. PATENT DOCUMENTS

| | | | | |
|---|---|---|---|---|
| 4,054,871 A | | 10/1977 | Terrell et al. | 343/7.7 |
| 4,290,126 A | | 9/1981 | McFadyen et al. | 367/93 |
| 4,319,349 A | | 3/1982 | Hackett | 367/94 |
| 4,625,199 A | | 11/1986 | Pantus | 340/522 |
| 4,807,255 A | * | 2/1989 | Idland | 367/93 |
| 4,949,313 A | * | 8/1990 | Iwasawa | 367/7 |
| 5,973,996 A | | 10/1999 | Zhevelev et al. | 367/99 |
| 6,018,696 A | * | 1/2000 | Matsuoka et al. | 701/207 |
| 6,457,364 B1 | * | 10/2002 | Howell | 73/602 |

OTHER PUBLICATIONS

Yi-Tsung Chien, Hung-Xin Zhao, Yea-Shuan Huang, "A Robust Sensor Connection For Intrusion Detection", Advanced Technology Center, Computer & Communications Research Laboratories, Industrial Technology Research Institute, Chutung, Hsinchu, Taiwan 310,R.O.C., P1-P5, CVCIP 2004, Aug. 15, 2004~Aug. 17, 2004.

Douglas A. Reynolds, Member, IEEE, and Richard C. Rose, Member, IEEE "Robust Text-Independent Speaker Identification Using Gaussian Mixture Speaker Models", IEEE Transactions on Speech and Audio Processing, vol. 3, No. 1, Jan. 1995, P72~P83.

Kentaro Toyama, John Krumm, Barry Brumitt, Brian Meyers, "Wallflower: Principles and Practice of Background Maintenance", Microsoft Research Redmond, WA 98052, {kentoy|jckrumm|barry|brianme}@microsoft.com.

* cited by examiner

*Primary Examiner*—Benjamin C Lee
*Assistant Examiner*—Sisay Yacob

(57) ABSTRACT

A method for and system of intrusion detection by using ultrasonic signals are provided. The method includes a training phase and a detection phase. The training phase includes capturing multi-echo signals when no intrusion is present under surveillance. The captured ultrasonic multi-echo signals are analyzed and features are extracted, learned and modularized. The detection phase includes a continuous collection of ultrasonic multi-echo signals. The captured signals are analyzed and features are extracted to compare with the features learned during the training phase. When intrusion is present, the features will be substantially different from the features learned in the training phase. Thus, an intruder can be detected. Experimental results indicate that when MDR is less than 0.1%, the FAR would be less than 2.5% for the invention. Therefore, this invention is applicable to intrusion detection.

15 Claims, 8 Drawing Sheets

METHOD FOR AND SYSTEM OF INTRUSION DETECTION BY USING ULTRASONIC SIGNALS

FIELD OF THE INVENTION

The present invention generally relates to intrusion detecting, and more specifically to a method for and system of intrusion detection by using ultrasonic signals. It is applicable to such a warehouse protection system, a factory monitoring system, and a vehicle intrusion alarm system.

BACKGROUND OF THE INVENTION

The conventional intrusion detection method uses cameras to capture images, and determines if an intruder is present by comparing the captured images. By using a camera to capture image, the surveillance area must be well-lit, especially at night in order to guarantee the quality of the captured image. The energy consumption is usually high using the conventional methods. In addition, because the lighting changes in the environment are usually frequent, complicated and unpredictable, false alarms are quite common when using image comparison. For example, a sunny day and an overcast day may generate quite different images; turning off the light in the corridor may affect the lighting condition in a room; the reflection of the surrounding objects in the monitor, and so on. All these problems pose difficult challenges for around-the-clock surveillance using image comparison.

Another technique commonly used in many intrusion detection methods is infrared. The use of passive infrared is to take advantage of the temperature difference among a number of regions, while the use of active infrared relies on the changes of the strength of the reflected signal. The former has the disadvantage of making mistake when surrounding temperature is high or unstable, for example: working heater and flame of the candle. Moreover, it is unable to detect a person covered with an insulating coating. The disadvantage of the active infrared method is that it can only detect a small area, usually along the line of sight. While radar is also used in Doppler methods to detect the speed of objects, it is not an appropriate solution for the indoor as it is too expensive and with a large volume.

The preprocess, feature extraction, and background module training have been used in many audio or image recognition applications and applicable to ultrasonic signals. As the ultrasonic detector can detect different signal features depending on the presence or the absence of an object within the detection range, it does not reply on the lighting and temperature changes in the surroundings. It is possible to exploit this trait in intrusion detection to replace the aforementioned methods troubled by some problems.

U.S. Pat. No. 4,319,349 disclosed an ultrasonic alarm system to detect the Doppler-shifted components which indicate the presence of moving objects in a protected area. It preprocess the transmitter signal and allows much simpler receiver circuitry to detect Doppler-shifted echoes indicating the presence of an intruder while rejecting similar echoes caused by non-intrusive objects which would otherwise produce a false alarm. However, the system has the disadvantage of being unable to detect a static or slowly moving object.

The prior arts mentioned above may be used as automatically controlling systems. However, they are not suitable to be used for intrusion detection, because of being understood their weakness and people can be trained to fool this system.

SUMMARY OF THE INVENTION

The present invention has been made to overcome the aforementioned drawbacks of conventional intrusion detection methods. The primary object of the present invention is to provide an intrusion detection method by using ultrasonic signals. By extracting the features of the ultrasonic signals and analyzing difference, the present invention can detect the presence or absence of an object regardless of condition effect of the surveillance environment. Thereby, it is free of environment interference, and very hard to be faked.

To achieve the aforementioned advantages, the intrusion detection method of the invention includes a training phase and a detection phase. The training phase is proceeded when there is no intrusion. In the training phase, a set of ultrasonic signals is captured from an ultrasonic sensor. Then, the preprocess and feature extraction of the ultrasonic signal set are performed. After that, feature training is conducted in order to establish at least one background module which is used for comparison in the detection phase. In the detection phase, ultrasonic signals are also collected, and same feature extraction for the ultrasonic signals is done. Then, a testing feature is formed by sampling a plurality of the extracted features. The testing feature is compared with the background module established in the training phase. Based on the results of the comparison, whether an intruder is detected or not is determined.

Another object of the present invention is to provide an intrusion detection system by using ultrasonic signals. The intrusion detection system comprises a signal capturing unit, a microprocessor, a random access memory (RAM), a programmable read only memory (PROM) for storing background modules, and a control unit.

The invention integrates the preprocess, feature extraction, and background module training techniques to the multi-echo ultrasonic signals. According to the invention, the ultrasonic signals may be multi-echo or single-echo ultrasonic signals. The single-echo ultrasonic signal is a sequence of single-echoes of the sensor, while multi-echo one is assembly of multi-echoes of the sensor. The preprocess can be noise filtering or signal amplifying and the feature extraction of the ultrasonic signals can be done by using wavelet transform (WT) technique or discrete cosine transform (DCT) technique. The background module can be established by using neural network (NN) or Gaussian mixture model (GMM).

The presence of an intruding person or object can affect a single-echo to multi-echo ultrasonic signals. Therefore, the detection strategy of the invention can perform the feature extraction on multi-echo ultrasonic signals to build a testing feature for comparison with the background module, or on individual single-echo signals then summarizes the individual comparison result, to reach the final conclusion. When the ultrasonic signals show different features from the background module, an intruder is detected.

The experimental results indicate that when the miss detection rate (MDR) is less than 0.1%, the false alarm rate (FAR) is less than 2.5% for the invention. Therefore, the present invention can be applicable to intrusion detection.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
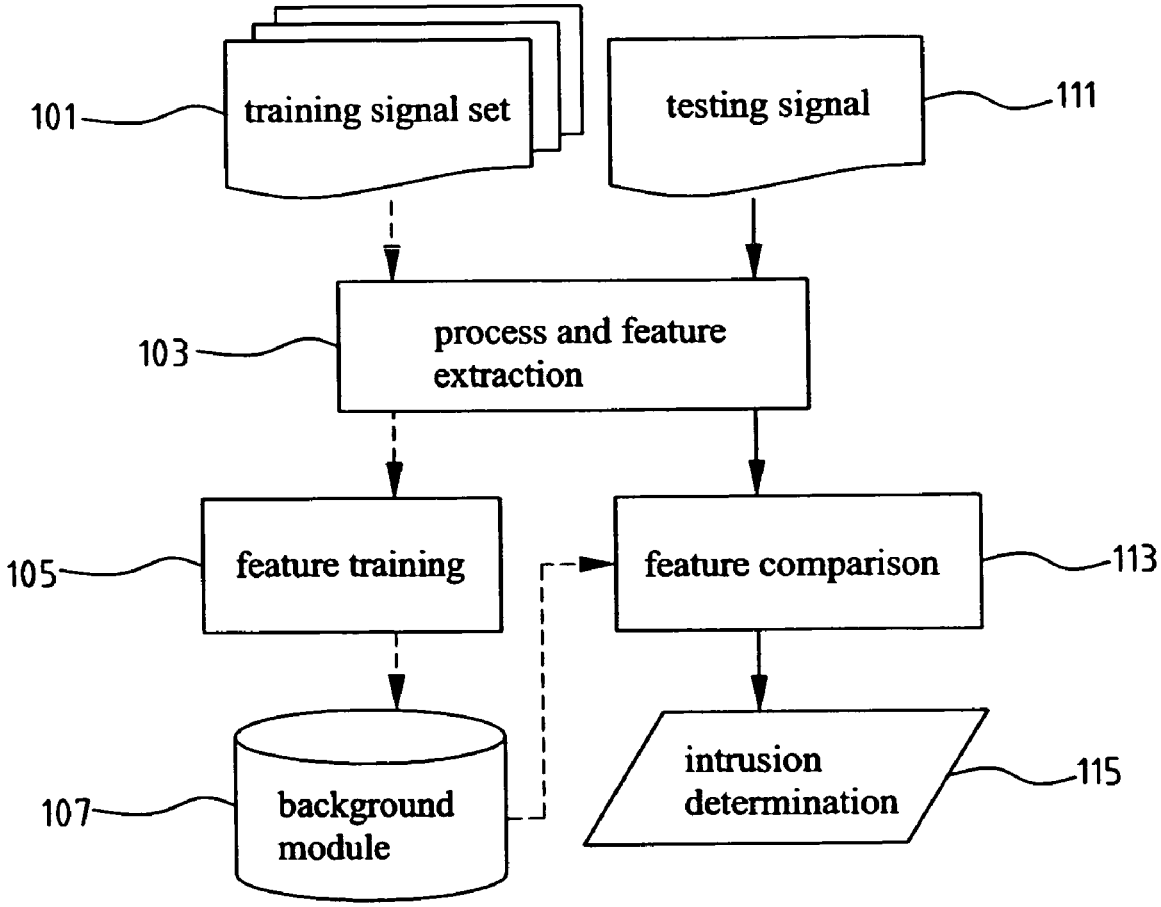
FIG. 1 shows a flowchart illustrating the operating flow of the intrusion detection method by using ultrasonic signals according to the invention.

FIG. 1 shows the operating flow of the intrusion detection method by using ultrasonic signals according to the invention. Referring to FIG. 1, the intrusion detection method includes a training phase (shown in dotted arrows) and a detection phase (shown in solid arrows). The training phase proceeds when an intrusion does not occur. In the training phase, continuous ultrasonic echoes captured from an ultrasonic sensor are combined to signals and many signals in a moment are formed as a training signal set 101. Then, the preprocess and feature extraction 103 for the training set are performed. After that, feature training 105 is conducted in order to establish at least one background module 107 which is used for comparison in the detection phase. In the detection phase, an ultrasonic signal (testing signal 111) is also collected, and same preprocess and feature extraction 103 for the detection signals are done. By sampling a plurality of the extracted features, they are compared with the background module 107 established in the training phase as shown in block 113. Based on the results of the comparison, whether there is intruder or not is determined, as shown in block 115.

Figure 2:
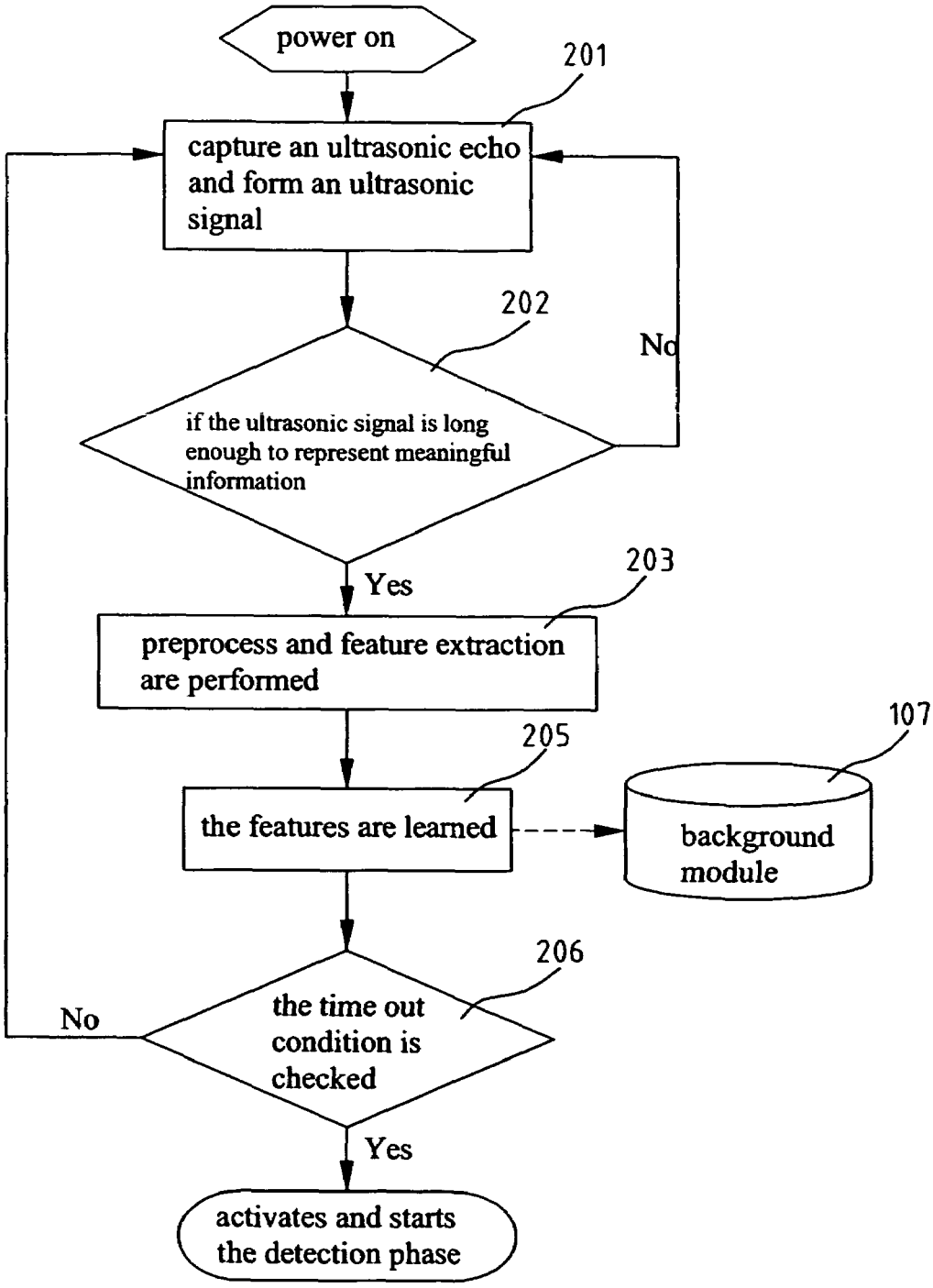
FIG. 2 shows the detailed steps of the training phase in FIG. 1.

FIG. 2 shows the detailed steps of the training phase in FIG. 1. Referring to FIG. 2, the training phase starts with power on. Once the power is on, it captures an ultrasonic echo and forms an ultrasonic signal (step 201), then checks if the ultrasonic signal is long enough to represent meaningful information (step 202). If yes, then preprocess and feature extraction are performed (step 203); otherwise, returns to step 201 to continue capturing an ultrasonic echo and combines it to the next signal. After step 203, the features are learned in step 205 and update the background module 107 in a storage. In step 206, the time out condition is checked. If the time is not out, then returns to step 201 to capture more ultrasonic signals for training; otherwise, the background module is ready for further use in the detection phase and then activates and starts the detection phase.

Figure 3:
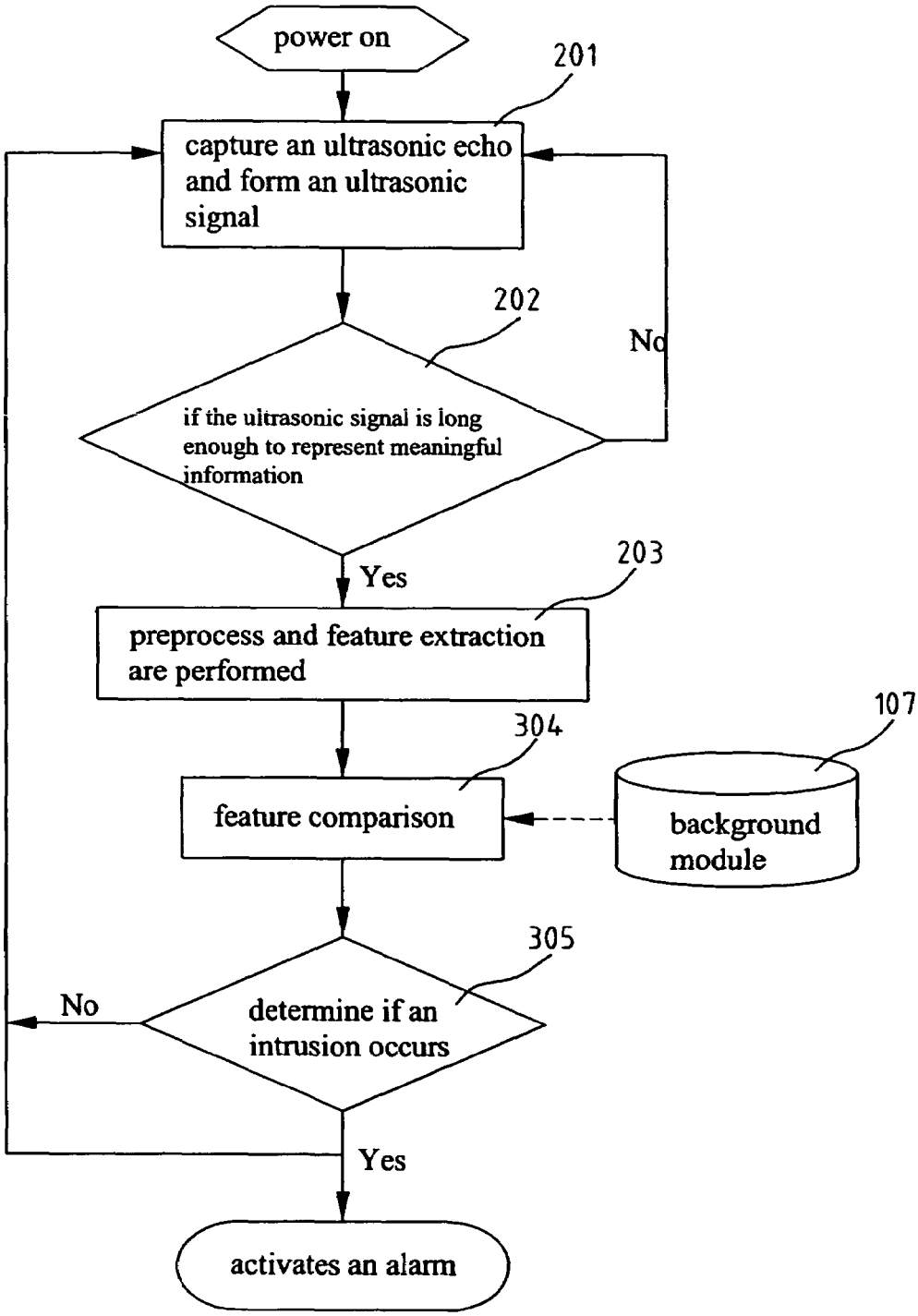
FIG. 3 shows the detailed steps of the detection phase in FIG. 1.

FIG. 3 shows the detailed steps of the detection phase in FIG. 1. The detection phase initializes at the end of the training phase. Referring to FIG. 3, steps 201-203 are also performed in the detection phase. After step 203, the newly extracted feature of the detection signal is compared with the background module 107 stored during the training phase, as shown in step 304. Based on the results of the comparison, it is to determine if an intrusion occurs, as shown in step 305. If so, it activates an alarm; otherwise, returns to step 201 and continues the detection phase to analyze the next ultrasonic signal.

The echoes of the ultrasonic sensor show up layout of the surrounding objects. The ultrasonic signals are continuous connection of the echoes in time domain and may be multi-echo or single-echo ultrasonic signals in the invention. When there is no intrusion, the ultrasonic signals are at a stable status. The presence of an intruding person or object can disturb a single-echo to multi-echo ultrasonic signals to be different from original stable signals. Therefore, the detection strategy can perform the feature extraction on ultrasonic signals for comparison with the background module, or on individual single-echo signals then summarizes the individual comparison result to reach the final conclusion. When the ultrasonic signals show different features from the background module, it concludes that an intruder is detected.

An ultrasonic signal is a one-dimensional sequence, like a waveform which is the connection of ultrasonic echoes. Therefore, the feature extraction of the signals can be done by using wavelet transform technique or discrete cosine transform technique. In addition, some preprocess techniques, such as noise reduction, or signal amplification, can be applied before the transformation. The background module can be established by using neural network or Gaussian mixture model.

Figure 4:
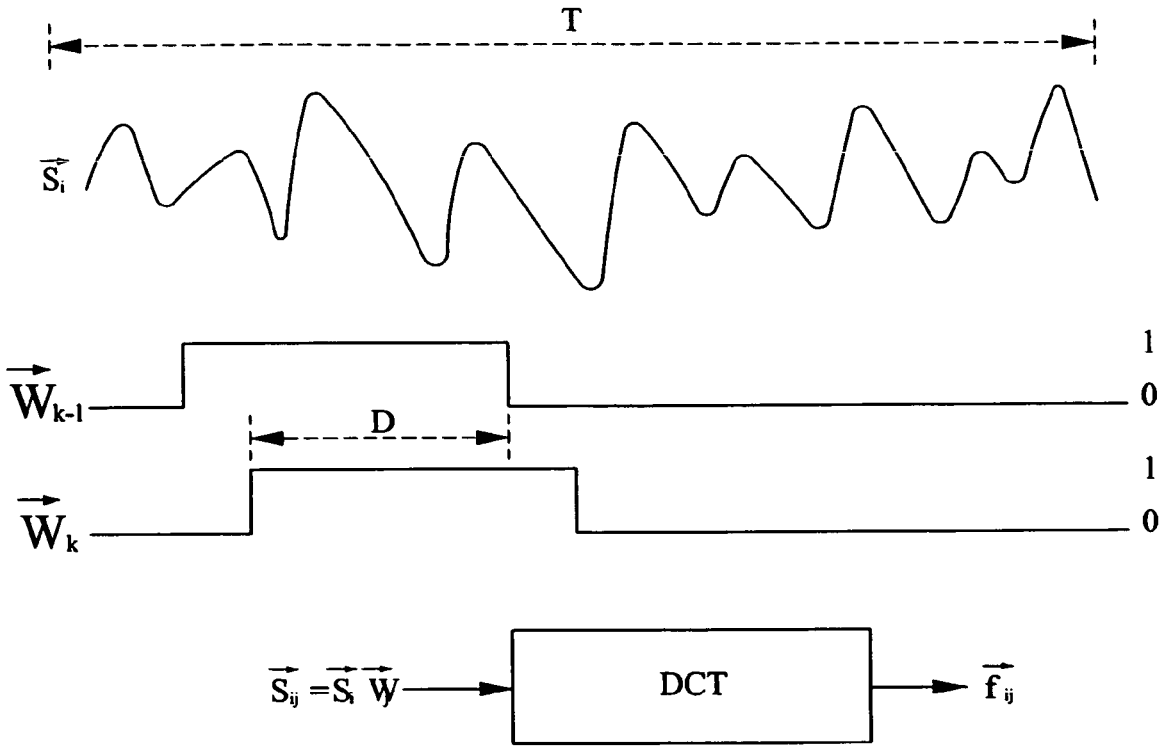
FIG. 4 shows an example on how to perform the feature extraction on a signal in FIG. 1.

FIG. 4 shows an example on how to perform the feature extraction in FIG. 1. Referring to FIG. 4, the feature extraction is to apply a window $\vec{w}$ of size W to N-echo signals $\vec{s}_i$, i=1, 2, . . . , N of time length T, then move the window $\vec{w}$ forwards a distance each time so that the new window $\vec{w}_k$ and the previous window $\vec{w}_{k-1}$ have an overlapped size D. By repeating the movement of window M times on the N-echo signals $\vec{s}_{ij}$, i=1, 2, . . . , N, j=1, 2, . . . , M, the DCT coefficients of the ultrasonic signals are extracted as the features $\vec{f}_{ij}$, i=1, 2, . . . , N, j=1, 2, . . . , M, as shown in FIG. 4. The features of the separate signals are collected to a training set $$\left\{\vec{f}_j = \bigcup_{\forall i} \vec{f}_{ij}\right\}, \quad j = 1, 2, \ldots, M.$$

Figure 5:
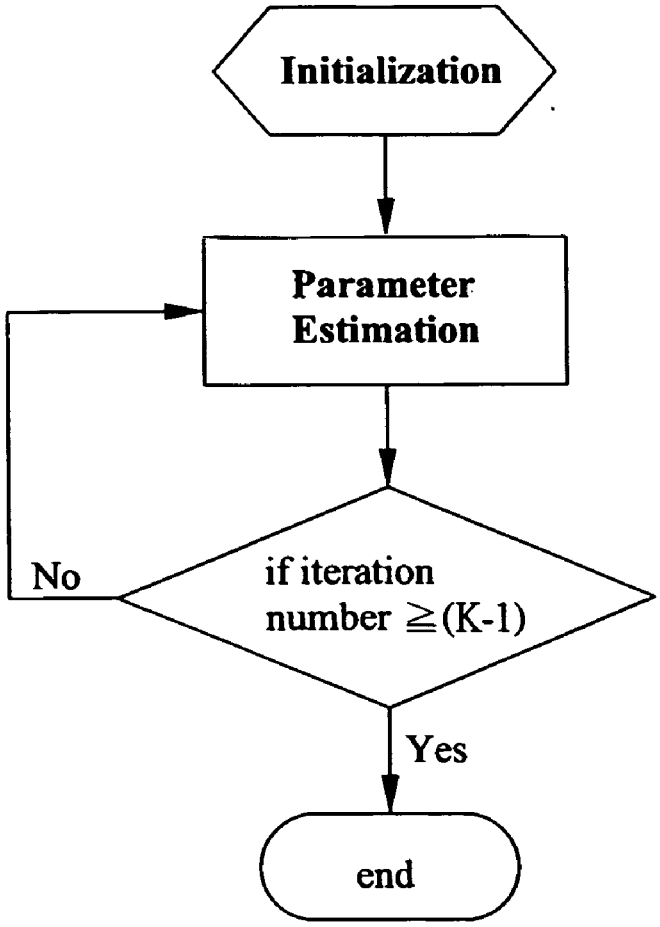
FIG. 5 shows an example on how to perform the feature training to build the background module in FIG. 1.

Using GMM to modularize the training set, as shown in FIG. 5, the background module can be expressed as the following parameters:

$$\lambda=\{p_i, \vec{u}_i, \Sigma_i\}, \; i=1, 2, \ldots, C$$

These parameters represent, respectively, the mixture weight, mean vector and covariance matrix of C groups (mixtures) in the GMM, and $$\sum_{k=1}^{c} p_k = 1.$$

The training phase includes the calculation of these parameters K times, with using the result from the previous iteration as the initial value of the next iteration. The estimations of the parameters at each iteration are as the following:

$$\vec{p}_i = \frac{1}{M}\sum_{j=1}^{M} p(i \mid \vec{f}_j, \lambda)$$

$$\vec{\mu}_i = \frac{\sum_{j=1}^{M} p(i \mid \vec{f}_j, \lambda)\vec{f}_j}{\sum_{j=1}^{M} p(i \mid \vec{f}_j, \lambda)}$$

$$\vec{\sigma}_i^2 = \frac{\sum_{j=1}^{M} p(i \mid \vec{f}_j, \lambda) f_j^2}{\sum_{j=1}^{M} p(i \mid \vec{f}_j, \lambda)} - \vec{\mu}_i^2$$

Where $\sigma_i$ is the i-th value in the diagonal of the covariance matrix, and $$p(i \mid \vec{x}, \lambda) = \frac{p_i b_i(\vec{x})}{\sum_{j=1}^{C} p_j b_j(\vec{x})}$$

$$b_i(\vec{x}) = \frac{1}{(2\pi)^{NW/2} \left|\sum_i\right|^{1/2}} \exp\left\{-\frac{1}{2}(\vec{x}-\vec{\mu}_i)' \sum_i^{-1} (\vec{x}-\vec{\mu}_i)\right\}$$

The detection phase is to extract the testing feature $\vec{f}$ from the ultrasonic signals (as in training phase mentioned before), then compare this testing feature with the background module λ, and obtain a likelihood value LK. If the value of LK is larger than a pre-determined threshold, it concludes to be an intrusion; otherwise, no intrusion is present. The method for obtaining the LK value is as the following:

$$Lk(\vec{f} \mid \lambda) = \log p(\vec{f}_i \mid \lambda)$$

where $$p(\vec{x} \mid \lambda) = \sum_{i=1}^{C} p_i b_i(\vec{x})$$

Figure 6:
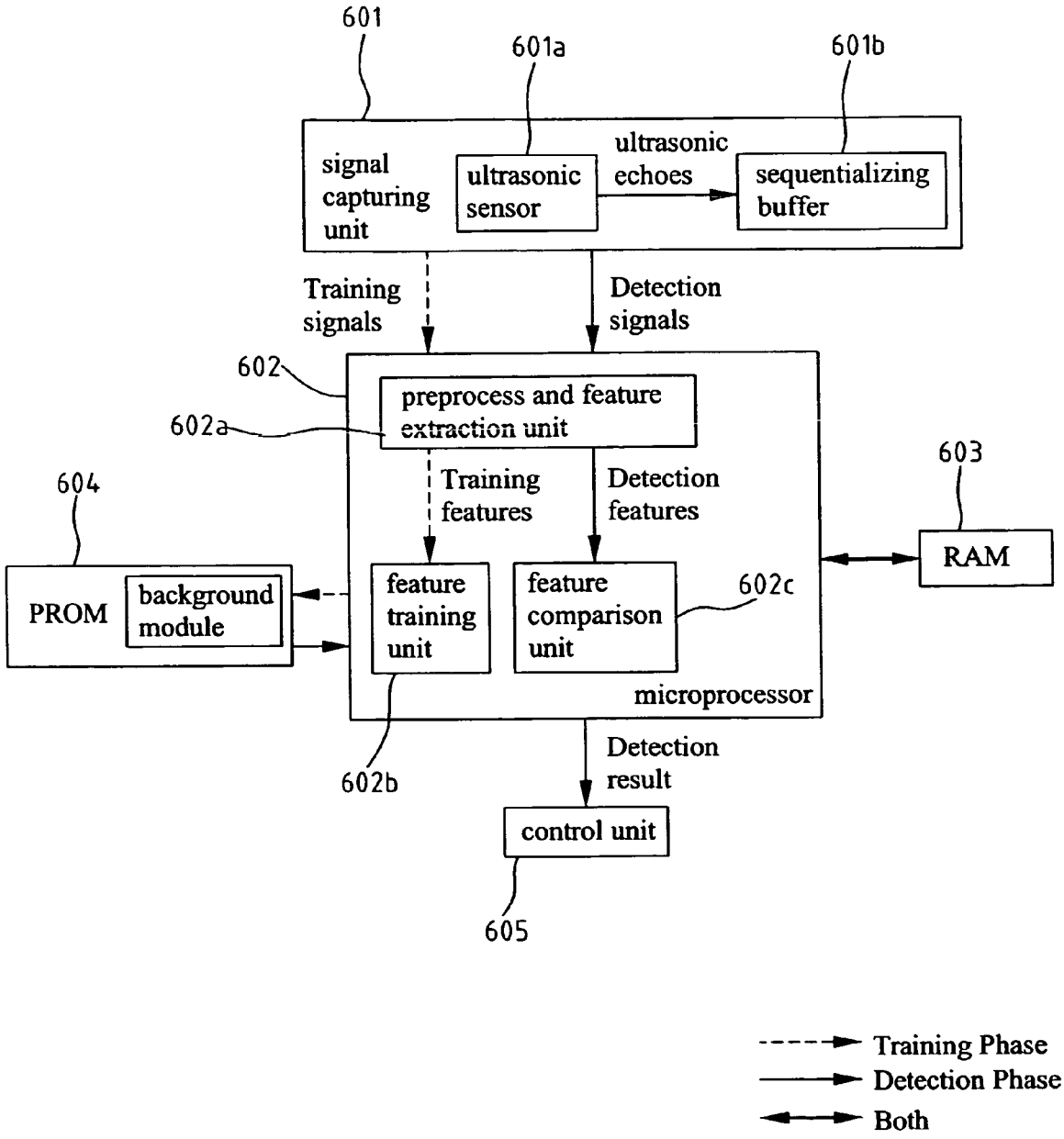
FIG. 6 shows a block diagram of the intrusion detection system according to the invention.

The intrusion detection method of the invention can be implemented with an ultrasonic intrusion detection system, as shown in FIG. 6. Referring to FIG. 6, the ultrasonic intrusion detection system comprises a signal capturing unit 601, a microprocessor 602, a RAM 603, a PROM 604 for storing background modules, and a control unit 605. The signal capturing unit 601 further includes an ultrasonic sensor 601*a* and a sequentializing buffer 601*b*. The microprocessor 602 further includes a preprocess and feature extraction unit 602*a*, a feature training unit 602*b* and a feature comparison unit 602*c*.

The training phase includes signal capturing, preprocess and feature extraction to obtain training features, and the training features are learned and stored in a storage as the background module. Therefore, in the training phase, the signal capturing unit 601 gets ultrasonic echoes from an ultrasonic sensor 601*a*, forms the ultrasonic signals in sequentializing buffer 601*b*, and save the signals to RAM 603. A training timer is used to time the duration required for collecting signals. After timer out, the microprocessor 602 gets before capturing signals (training set) in RAM and performs preprocess and feature extraction 602*a* to obtain training features. The training features are learned and stored in the PROM 604 as the background module.

The detection phase includes signal capturing, preprocess and feature extraction to obtain testing features, which are compared with the background module loaded from storage. Therefore, in the detection phase, the signal capturing unit 601 gets ultrasonic echoes from an ultrasonic sensor 601*a*, forms the ultrasonic signals in sequentializing buffer 601*b*, and passes the signals to the microprocessor 602. The microprocessor performs preprocess and feature extraction to obtain testing feature. The testing feature is compared with the background module and the detection result is sent to control unit 605. The control unit 605 determines whether an intruder occurs or not, according to the comparison result and activates messages if needed. The RAM 603 stores the temporary data proceeded by the microprocessor 602 in both training and detection phases.

Figure 7:
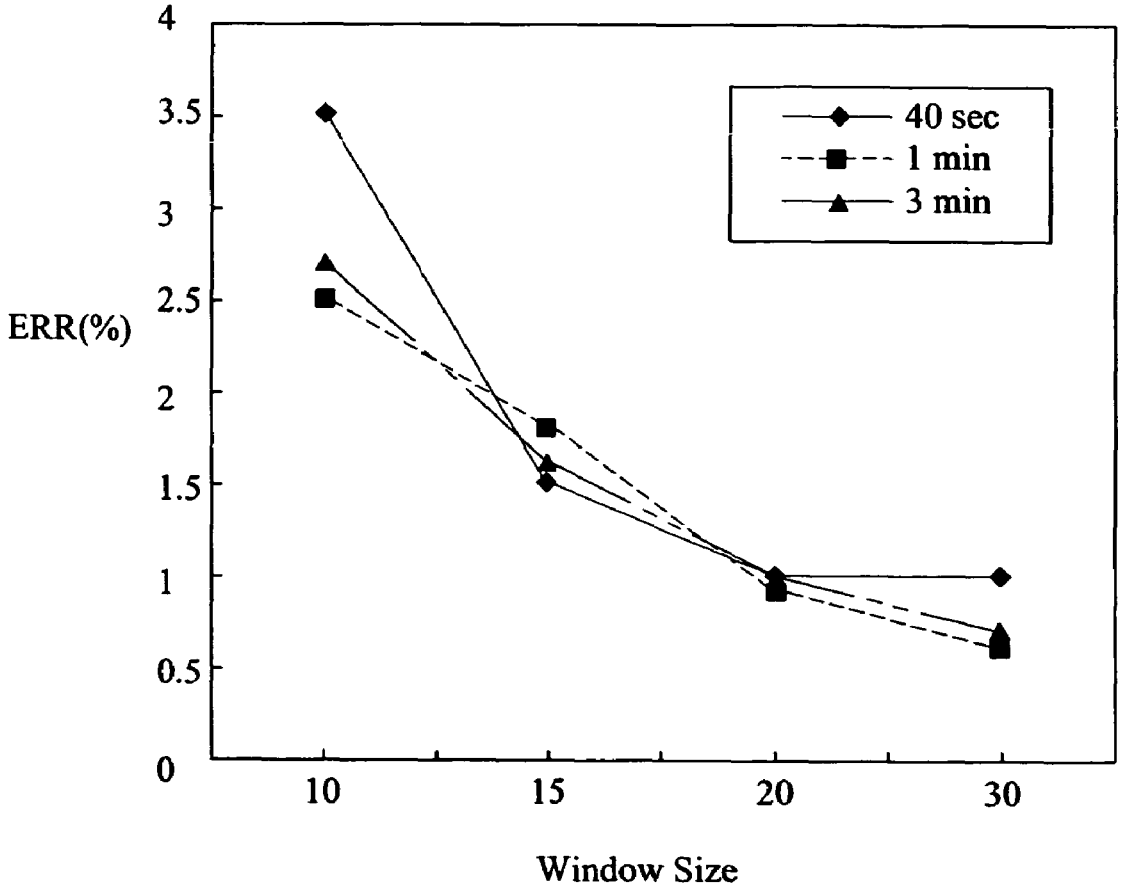
FIG. 7 shows the relationship among window size, length of ultrasonic signal, and equal error rate (ERR) in an experimental environment according to the invention.

Many experiments are performed on various factors for demonstrating the present invention. FIG. 7 shows the relationship among the window size W, the length of ultrasonic signals T, and the equal error rate in an experimental environment according to the invention. The equal error rate is the value that the false alarm rate equals to the miss detection rate. In the experimental environment, the overlapped window size D=W−1, the mixtures number C=20, initial value of the mixture weight p=1/C, initial value of the mixture means μ are randomly chosen from the training set, the initial covariance matrices are unit matrices, and the modeling iterative number K=20. The database includes background echoes of the ultrasonic sensor taken for 4.8 hours of no people and intruded echoes of the sensor for 20 minutes. The capturing frequency for the ultrasonic signals is around 15 Hz.

From FIG. 7, it can be seen that if W is increased, then the ERR is decreased. However, this will delay the time that an intruder is detected. Moreover, if T is long enough, then increasing it's value will not decrease the ERR. When W=20 and T=40, then an intruder is detected within 0.7 second with ERR=1%.

Figure 8:
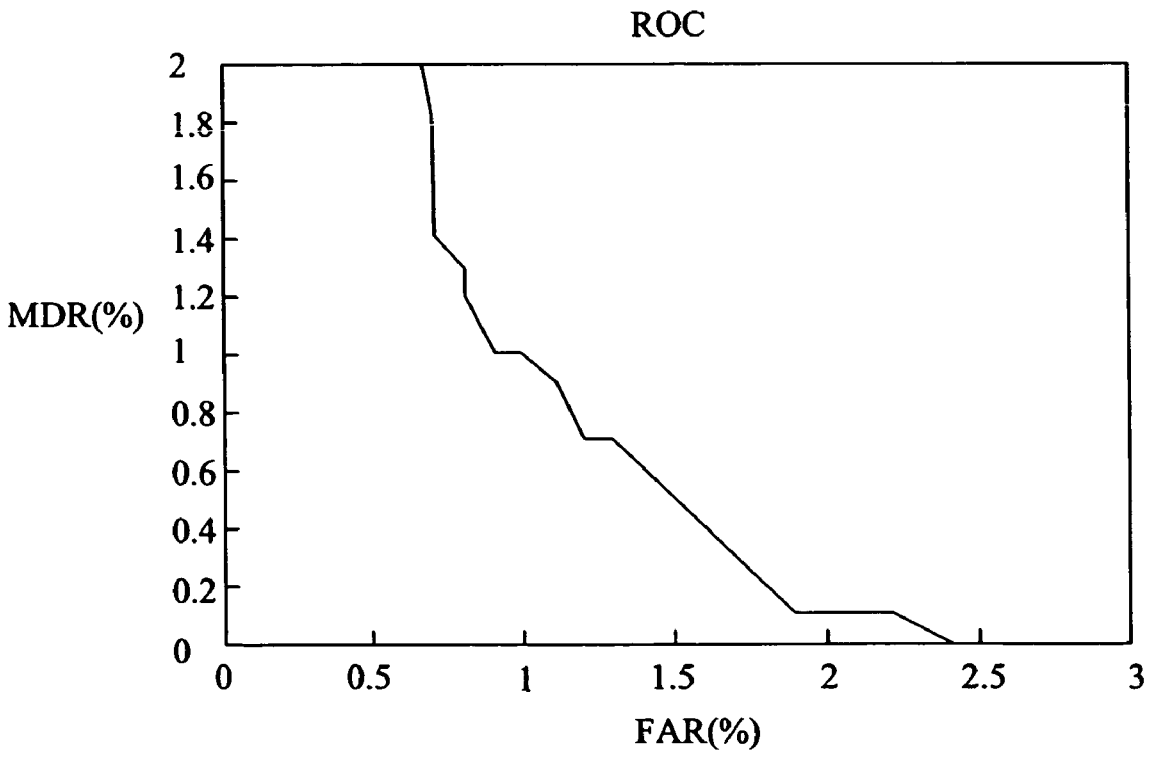
FIG. 8 shows a receiver operating characteristics (ROC) curve of false alarm rate versus miss detection rate according to the example of the invention.

FIG. 8 shows a receiver operating characteristics curve of FAR versus MDR according to the invention. From FIG. 8, it can be seen that when MDR<0.1%, FAR<2.5%. Currently, an intrusion detection system with MDR<0.1% and FAR<5% is widely acceptable. Therefore, the present invention is applicable to intrusion detection.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An intrusion detection method by using ultrasonic signals, said intrusion detection method including a training phase and a detection phase, said training phase being performed when an intrusion does not occur, said training phase comprising the steps of:

(a) sequentially capturing plural ultrasonic echoes from an ultrasonic sensor to form one or more ultrasonic signals;

(b) performing signal processing and feature extraction for said ultrasonic signals; and (c) conducting a feature training to establish at least one background module which is used for comparison in said detection phase;

said detection phase comprising the steps (a), (b), and the following steps of:

(d) forming testing features by sampling a plurality of the extracted features in step (b);

(e) comparing said testing features with said background module established in said training phase; and (f) determining if an intruder is detected according to the results of comparison from step (e);

wherein said feature extraction for said ultrasonic signals in step (b) is done by the following steps:

(b1) applying a size of window to a length of said ultrasonic signals;

(b2) moving said window forwards a distance each time so that a new window and a previous window have an overlap; and (b3) extracting coefficients of a transformation on said ultrasonic signals in the overlapped windows as features.

2. The intrusion detection method as claimed in claim 1, wherein said ultrasonic signals are single-echo ultrasonic signals.

3. The intrusion detection method as claimed in claim 1, wherein said ultrasonic signals are multi-echo ultrasonic signals.

4. An intrusion detection method by using ultrasonic signals, said intrusion detection method including a training phase and a detection phase, said training phase being performed when an intrusion does not occur, said training phase comprising the steps of:

(a) sequentially capturing plural ultrasonic echoes from an ultrasonic sensor to form one or more ultrasonic signals;

(b) performing signal processing and feature extraction for said ultrasonic signals; and (c) conducting a feature training to establish at least one background module which is used for comparison in said detection phase;

said detection phase comprising the steps (a), (b), and the following steps of:

(d) forming testing features by sampling a plurality of the extracted features in step (b);

(e) comparing said testing features with said background module established in said training phase; and (f) determining if an intruder is detected according to the results of comparison from step (e);

wherein said steps (a), (b), and (c) in said training phase comprise the following steps for operating flow:

(t1) capturing an ultrasonic echo to form an ultrasonic signal;

(t2) checking if said ultrasonic signal in step (t1) is long enough to represent meaningful information, if not, returning to step (t1);

(t3) collecting said ultrasonic signals as a training set, then performing signal processing and feature extraction for said training set;

(t4) said extracted features being learned and stored as a background module for further comparison in said detection phase; and (t5) checking a time out condition and if time is not out, returning to step (t1) to capture more ultrasonic signals, otherwise, activating and staffing said detection phase.

5. The method as claimed in claim 1, wherein if an intrusion occurs in step (f), then said detection phase activates an alarm, otherwise, it returns to step (a) and continues the detection phase to capture next ultrasonic signal.

6. The method as claimed in claim 1, wherein in step (f), when said ultrasonic signals show different features from said background module, it is determined that an intruder is detected.

7. The method as claimed in claim 1, wherein in said detection phase, said feature extraction is performed on multi-echo ultrasonic signals to form said testing features.

8. The method as claimed in claim 1, wherein in said detection phase, said feature extraction is performed on single-echo ultrasonic signals to form said testing features.

9. The method as claimed in claim 1, wherein said transformation is a wavelet transformation.

10. The method as claimed in claim 1, wherein said transformation is a discrete cosine transformation.

11. The method as claimed in claim 1, wherein said background module is established by using neural network.

12. The method as claimed in claim 1, wherein said background module is established by using Gaussian mixture model.

13. An ultrasonic intrusion detection system by using ultrasonic signals, comprising:

a signal capturing unit for capturing plural ultrasonic echoes, forming one or more ultrasonic signals, and collecting said ultrasonic signals;

a microprocessor for receiving said ultrasonic signals, and performing signal processing and feature extraction to obtain a plurality of features, and said plurality of features being learned as at least one background module or compared with said background module;

a random access memory for storing the data processed by said microprocessor;

a programmable read only memory for storing said background module;

and a control unit for determining whether an intruder occurs or not, according to comparison results generated by said microprocessor;

wherein said microprocessor comprises a preprocessing and feature extraction unit for applying a window to a length of said ultrasonic signals, moving said window forwards a distance each time so that a new window and a previous window have an overlap; and extracting coefficients of a transformation on said ultrasonic signals in the overlapped windows to obtain said plurality of features.

14. The ultrasonic intrusion detection system as claimed in claim 13, wherein said microprocessor further comprises:

a feature learning unit for learning said plurality of features as said background module or as testing features; and a feature comparison unit for comparing said testing features with said background module, and generating comparison results for said control unit.

15. The ultrasonic intrusion detection system as claimed in claim 13, wherein said signal capturing unit includes an ultrasonic sensor for generating said plural ultrasonic echoes, and a sequentializing buffer for forming one or more ultrasonic signals.

* * * * *